US009005521B2

(12) United States Patent
Ookubo

(10) Patent No.: US 9,005,521 B2
(45) Date of Patent: Apr. 14, 2015

(54) CU—NI—SI ALLOY FOR ELECTRONIC MATERIAL

(75) Inventor: Mitsuhiro Ookubo, Hitachi (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 270 days.

(21) Appl. No.: 13/638,806

(22) PCT Filed: Apr. 2, 2010

(86) PCT No.: PCT/JP2010/056075

§ 371 (c)(1),
(2), (4) Date: Oct. 1, 2012

(87) PCT Pub. No.: WO2011/125153

PCT Pub. Date: Oct. 13, 2011

(65) Prior Publication Data

US 2013/0014861 A1 Jan. 17, 2013

(51) Int. Cl.

| | |
|---|---|
| ***C22C 9/06*** | (2006.01) |
| ***C22C 9/10*** | (2006.01) |
| ***C22F 1/08*** | (2006.01) |
| ***C22C 1/10*** | (2006.01) |
| ***C22F 1/00*** | (2006.01) |

(52) U.S. Cl.

CPC ... *C22C 9/06* (2013.01); *C22F 1/08* (2013.01); *C22C 1/10* (2013.01); *C22F 1/00* (2013.01)

(58) Field of Classification Search

None

See application file for complete search history.

(56) References Cited

U.S. PATENT DOCUMENTS

| | | | | |
|---|---|---|---|---|
| 2002/0119071 | A1* | 8/2002 | Usami et al. | 420/476 |
| 2005/0236074 | A1 | 10/2005 | Mihara et al. | |
| 2009/0257909 | A1* | 10/2009 | Mihara et al. | 420/485 |
| 2010/0221576 | A1* | 9/2010 | Mihara et al. | 428/687 |
| 2011/0240182 | A1* | 10/2011 | Kuwagaki | 148/682 |
| 2011/0247857 | A1* | 10/2011 | Tsukamoto et al. | 174/113 R |
| 2011/0259480 | A1* | 10/2011 | Hirose et al. | 148/501 |

FOREIGN PATENT DOCUMENTS

| | | | |
|---|---|---|---|
| EP | 0949343 | A1 * | 10/1999 |
| EP | 1973120 | A1 * | 9/2008 |
| EP | 2048251 | A1 | 4/2009 |
| EP | 2143810 | A1 * | 1/2010 |
| EP | 2154257 | A1 * | 2/2010 |
| JP | 10-219374 | A | 8/1998 |
| JP | 2006-265731 | A | 10/2006 |
| JP | 3977376 | B2 | 9/2007 |
| JP | 2008-024999 | A | 2/2008 |
| JP | 2008-127668 | A | 6/2008 |
| JP | 2009-242890 | A | 10/2009 |
| JP | 2009-242926 | A | 10/2009 |
| JP | 2010007174 | A | 1/2010 |
| WO | WO 02/08479 | A1 * | 1/2002 |
| WO | WO 2008/032738 | A1 | 3/2008 |
| WO | WO 2008/032738 | A1 * | 3/2008 |
| WO | WO 2008/038593 | A1 * | 4/2008 |

OTHER PUBLICATIONS

Machine translation of JP-2009-242926A (no date available).*
Supplementary European Search Report in EP 10849397.4, Feb. 11, 2014.

* cited by examiner

*Primary Examiner* — Kiley Stoner
(74) *Attorney, Agent, or Firm* — Drinker Biddle & Reath LLP

(57) ABSTRACT

The distribution of Ni—Si compound grains is controlled to thereby improve the properties of Corson alloys. The copper alloy for electronic materials comprises 0.4 to 6.0% mass of Ni and 0.1 to 1.4% by mass of Si, with the balance being Cu and unavoidable impurities.

The copper alloy comprising:

small particles of Ni—Si compound having a particle size of equal to or greater than 0.01 μm and smaller than 0.3 μm; and large particles of Ni—Si compound having a particle size of equal to of greater than 0.3 μm and smaller than 1.5 μm.

The number density of the small particles is 1 to 2000 pieces/$\mu m^2$ and the number density of the large particles is 0.05 to 2 pieces/$\mu m^2$.

9 Claims, 2 Drawing Sheets

CU—NI—SI ALLOY FOR ELECTRONIC MATERIAL

BACKGROUND OF THE INVENTION

1. Field of the Invention

The present invention relates to a precipitation hardened copper alloy, and more particularly, to a Cu—Ni—Si alloy suitable for the use in various components of electronic equipment.

2. Description of the Related Art

Copper alloys for electronic materials used in various components of electronic equipment such as lead frames, connectors, pins, terminals, relays, and switches are required to achieve a balance between high strength and high electrical conductivity (or thermal conductivity) as basic characteristics. In recent years, high integration, miniaturization and thickness reduction of electronic components are in rapid progress, and in this respect, a demand for a copper alloy to be used in the components of electronic equipment is rising to higher levels.

From the viewpoints of high strength and high electrical conductivity, the amount of use of precipitation hardened copper alloys is increasing in replacement of conventional solid solution hardened copper alloys represented by phosphor bronze and brass, as copper alloys for electronic materials. In a precipitation hardened copper alloy, as a supersaturated solid solution that has been solution-hot-treated is subjected to an aging treatment, fine precipitates are uniformly dispersed, so that the strength of the alloy increases, the amount of solid-solution elements in copper decreases, and also, electrical conductivity increases. For this reason, a material having excellent mechanical properties such as strength and spring properties, and having satisfactory electrical conductivity and thermal conductivity is obtained.

Among precipitation hardened copper alloys, Cu—Ni—Si copper alloys, which are generally referred to as Corson alloys, are representative copper alloys having relatively high electrical conductivity, strength, stress relaxation characteristic, and bending workability in combination, and constitute one class of alloys for which active development is currently underway in the industry. In this class of copper alloys, an enhancement of strength and electrical conductivity can be promoted by precipitating fine Ni—Si intermetallic compound particles in a copper matrix.

It has been known that the precipitation state of Ni—Si compound particles influences on the alloy characteristics.

Japanese Patent No. 3797736 (Patent Document 1) describes an invention including particles of Ni—Si compound particles with the particle size of equal to or greater than 0.003 μm and smaller than 0.03 μm (small particles), and particles with the particle size of 0.03 μm to 100 μm (large particles) and the ratio between the numbers of small particles and large particles is 1.5 or greater. In addition, the small particles with the particle size of smaller than 0.03 μm increase strength and heat resistance alloy, but rarely contribute to shear workability. Meanwhile, the large particles with the particle size of 0.03 μm or greater rarely contribute to an increase in strength and heat resistance of the alloy, but intensively receive stress at the time of a shear process, become sources of microcrack, and significantly increase the shear workability. In addition, it is mentioned that the copper alloy described in Japanese Patent No. 3797736 has significant shear workability together with strength and heat resistance required as copper alloy for electric and electronic component.

Japanese Patent No. 3797736 describes a method of producing copper alloy as follows.

1) Since grains are especially likely to be coarse if Ni content is 4 wt % or greater and Si content is 1 wt % or greater, molten metal after addition of Ni and Si is maintained at the temperature of 1300° C. or greater (or 5 minutes or greater, both are completely melted, and a cooling rate in a mold from a casting temperature to a solidifying temperature is 0.3° C./second or greater, in order to control measurements of grains into a desired scope.

2) Heat material after hot rolling is subjected to rapid cooling under water, and the material further subjected to cold rolling is heated at 500 to 700° C. for 1 minute to 2 hours to precipitate large particles. After that, the material is additionally subjected to cold rolling, and heated at 300 to 600° C. for 30 minutes or greater to precipitate small particles at this time.

3) Without performing rapid cooling at the time of cooling if hot rolling finishes, the material is maintained at 500 to 700° C. for 1 minute to 2 hours to precipitate large particles, and then subjected to rapid cooling. After the material is further subjected to cold rolling, the material is heated at 300 to 600° C. for 30 minutes or greater to precipitate small particles at this time.

In view of particle sizes of Ni—Si precipitates and other precipitates in the composition of copper alloy, and a relation between a ratio of distribution density and prevention of grains front being coarse, Japanese Patent No. 3977376 (Patent Document 2) describes precipitates X made from Ni and Si, and precipitates V that do not contain one or both of Ni and Si, and describes that a particle size of the precipitates X is 0.001 to 0.1 μm, and a particle size of the precipitates Y is 0.01 to 1 μm. In addition, in order to achieve compatibility between strength and bending workability, it is described that the number of the precipitates X is 30 to 2000 times of the number of the precipitates Y, and the number of the precipitates X is $10^8$ to $10^{12}$ per 1 $mm^2$, and the number of the precipitates Y is $10^4$ to $10^8$ per 1 $mm^2$.

Japanese Patent No. 3977376 describes a method of producing the copper alloy as follows.

If an ingot is subjected to hot rolling, the ingot is heated at the heating rate of 20 to 200° C./hour, subjected to hot rolling at 850 to 5050° C. for 0.5 to 5 hours, and subjected to rapid cooling so that the finishing temperature of the hot rolling is 300 to 700° C. Accordingly, the precipitates X and Y are generated. After the hot rolling, a desired plate thickness is obtained by combining, for example, solution treatment, annealing, and cold rolling.

The purpose of the solution treatment is to solid-solubilize Ni and Si precipitated at the time of casting and heating treatment again, and to perform recrystallization at the same time. The temperature of the solution treatment is adjusted according to the added amount of Ni. For example, the temperature is adjusted to 650° C. if the Ni amount is equal to or greater than 2.0 and less than 2.5% by mass, to 800° C. if the Ni amount is equal to or greater than 2.5 and less than 3.0% by mass, to 850° C. if the Ni amount is equal to or greater than 3.0 and less than 3.5% by mass, to 900° C. if the Ni amount is equal to or greater than 3.5 and less than 4.0% by mass, to 950° C. if the Ni amount is equal to or greater than 4.0 and less than 4.5% by mass, and to 980° C. if the Ni amount is equal to or greater than 4.5 and equal to or less than 5.0% by mass.

International Publication No. 2008/032738 (Patent Document 3) describes a copper alloy strip material for electrical electronic equipment which includes a copper alloy, containing 2.0 to 5.0 mass % of Ni, and 0.43 to 1.5 mass % of Si, with the balance being Cu and unavoidable impurities, and in which three types of intermetallic compounds A, B, and C including 50 mass % or greater of Ni and Si in total are contained, the intermetallic compound A has a compound diameter of equal to or greater than 0.3 μm and equal to or less than 2 μm, the intermetallic compound B has a compound diameter of equal to or greater than 0.05 μm and less than 0.3 μm, and the intermetallic compound C has a compound diameter of greater than 0.001 μm and less than 0.05 μm.

In addition, disclosed is a method of producing a copper alloy strip material for electrical/electronic equipment including a step of reheating a copper alloy ingot containing 2.0 to 5.0 mass % of Ni and 0.43 to 1.5 mass % of Si with the balance being Cu and unavoidable impurities at 850 to 950° C. for 2 to 10 hours, a step of performing hot rolling the reheated copper alloy ingot for 100 to 500 seconds to obtain a copper alloy strip material, a step of performing rapid cooling the copper alloy strip material subjected to hot rolling to a temperature of 600 to 800° C. and a step of performing an aging heat treatment on the copper alloy strip material subjected to rapid cooling, at 400 to 550° C. for 1 to 4 hours.

Patent document 1: Japanese Patent No. 3707736

Patent document 2: Japanese Patent No. 3977376

Patent document 3: International Publication No. 2008/032738

SUMMARY OF THE INVENTION

The copper alloy described in Japanese Patent No. 3797736 is only reviewed with regard to the ratio between the numbers of small particles and large particles, and is not described the number density of the particles. In addition Japanese Patent No. 3797736 describes the respective precipitation of large particles and small particles by perforating aging twice, but it is difficult to precipitate the small particles in a second aging since the concentration of Ni and Si to be solid-solubilized is lower than that of the particles in a first aging, and favorable influence on strength is insufficient since the number density and the particle size are small (see Comparative Example 5 described below). A technique of performing aging twice has a problem in that controlling the particle size and the density is difficult since the amount of Ni and Si to be solid-solubilized changes depending on the first aging.

In the copper alloy described in Japanese Patent No 3977376, the particle size of the Ni—Si compound particles is only controlled in the scope of 0.001 to 0.1 μm, and the influence on the alloy characteristic by the Ni—Si compound particles with greater particle size is not reviewed. The large particles described in Japanese Patent No. 3977376 are precipitates that do not contain one or both of Ni and Si. These large particles become coarse depending on the amount of additive elements or the temperature condition, and it is likely to exert adverse influence on bending workability.

In a process for producing the copper alloy described in International Publication No. 2008/032738, the condition in which large particles precipitate out is extremely unclear. In addition, in the method of producing the copper alloy described in International Publication No. 2008/032738, the solution treatment is carried out by performing heating at 950° C. for 20 seconds, but it is understood that the particle size exceeds 30 μm and the particles become coarse, if the solution treatment is performed in grains with the Ni concentration of 3.3% by mass exemplified in the document.

Therefore, the purpose of the invention is to enhance the characteristics of Corson alloy by strictly controlling the distribution state of Ni—Si compound particles.

The inventors of the invention conducted thorough investigations in order to solve the problems described above, and the inventors found that it is possible to obtain Corson alloy with excellent balance between strength and electrical conductivity and satisfactory bending workability classifying Ni—Si compound particles that precipitate out in a copper matrix into Ni—Si compound particles that mainly precipitate out in grains and that base a particle size of equal to or greater than 0.01 μm and less than 0.3 μm (small particles) and Ni—Si compound particles that mainly precipitate out to grain boundaries and that have a particle size of equal to or greater than 0.3 μm and less than 1.5 μm (large particles), and by controlling the respective sizes and number densities. In specific, the inventors found that it is effective that the small particles are controlled so that the size is equal to or greater than 0.01 μm and smaller than 0.3 μm, and the number density is 1 to 2000/μm$^2$, the large particles are controlled so that the size is equal to or greater than 0.3 μm and smaller than 1.5 μm, and the number density is 0.05 to 2/μm$^2$.

According to an aspect of the invention that has been completed based on the findings, there is provided a copper alloy for electronic materials which contains 0.4 to 6.0% by mass of Ni and 0.1 to 1.4% by mass of Si, with the balance being Cu and unavoidable impurities, including small particles of Ni—Si compound having a particle size of equal to or greater than 0.01 μm and smaller than 0.3 μm and large particles of Ni—Si compound having a particle size of equal to or greater than 0.3 μm and smaller than 1.5 μm, and in which the number density of the small particles is 1 to 2000/μm$^2$ and the number density of the large particles is 0.05 to 2/μm$^2$.

According to an embodiment, the copper alloy for electronic materials related to the invention is such that a maximum value of a density ratio per field with regard to the small particles is 10 or smaller if a unit area of 0.5 μm×0.5 μm is set to one field and 10 fields selected from a surface area of the copper alloy of 100 mm$^2$ are observed, and a maximum value of a density ratio per field with regard to the large particles is 5 or smaller if a unit area of 20 μm×20 μm is set to one field and 10 fields selected from a surface area of the copper alloy of 100 mm$^2$ are observed.

According to another embodiment, the copper alloy for electronic materials related to the invention is such that a ratio of an average particle size of the large particles with regard to an average particle size of the small particles is 2 to 50.

According to still another embodiment, the copper alloy for electronic materials related to the invention is such that an average grain size indicated by a circle-equivalent diameter is 1 to 30 μm if observed from a cross section in a thickness direction parallel to a rolling direction.

According to still another embodiment, the copper alloy for electronic materials related to the invention is such that a maximum value of a ratio of particle sizes of neighboring grains is 3 or less in length in the thickness direction parallel to the rolling direction.

According to still another embodiment, the copper alloy for electronic materials related to the invention contains at least one selected from the group consisting of Cr, Co, Mg, Mn, Fe, Sn, Zn, Al, and P in an amount of 1.0% by mass in total.

According to still another embodiment of the invention, there is provided a wrought copper product made from the copper alloy for electronic materials related to the invention.

According to still another embodiment of the invention, there is provided an electronic component prepared with the copper alloy for electronic materials related to the invention.

According to still another aspect of the invention, there is provided a method of producing the copper alloy related to the invention, the method including performing the following steps in order: melting and casting ingot having a desired composition after maintaining molten metal obtained by melting materials containing Ni and Si at 1130 to 1300° C. if Ni concentration is 0.4 to 3.0% by mass and maintaining the molten metal at 1250 to 1350° C. if Ni concentration is 3.0 to 6.0% by mass; performing hot rolling after heating at 800 to 900° C. if Ni in the ingot is less than 2.0% by mass, at 850 to 950° C. if Ni in the ingot is equal to or greater than 2.0% by mass and less than 3.0% by mass, at 900 to 1000° C. if Ni in the ingot is equal to or greater than 3.0% by mass and less than 4.0% by mass, and at equal to or greater than 950° C. if Ni in the ingot is 4.0% by mass or greater; performing cold rolling; performing a solution treatment at a solution treatment temperature y(° C.) indicated by y=125x+(475 to 525) if x is Ni concentration (% by mass) in the ingot; and performing an aging treatment.

According to the invention, it is possible to more effectively enjoy the benefit to an alloy characteristic owing to Ni—Si compound particles precipitated in copper matrix, so the characteristics of Corson alloy may increase.

Figure 1:
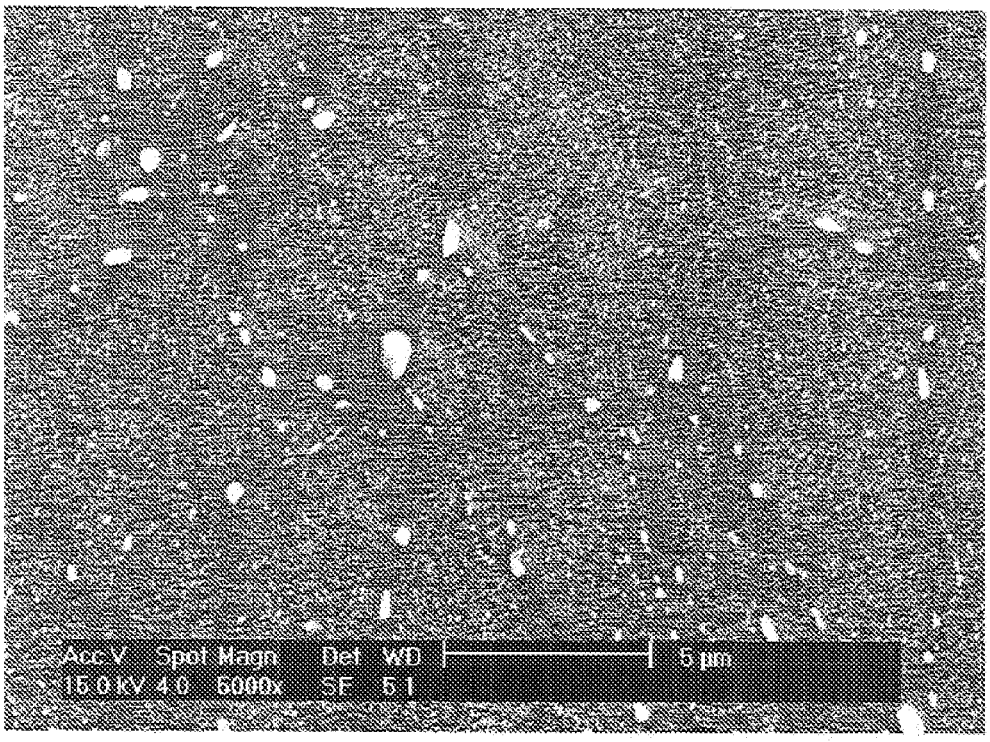
FIG. 1 is a photograph illustrating large particles in a cross-section in the thickness direction parallel to the rolling direction when observing copper alloy (which is processed by 0%) of the invention by SEM.

DETAILED DESCRIPTION OF THE PREFERRED EMBODIMENTS (Amounts of Addition of Ni and Si)

Ni and Si form a Ni—Si compound particle (such as $Ni_2Si$) as an intermetallic compound when subjected to an appropriate heat treatment, and strength may be enhanced without deteriorating electrical conductivity.

If the amounts of addition of Si and Ni are too small, the desired strength may not be obtained, and if the amounts are too large, strength may be enhanced, but electrical conductivity significantly decreases so that hot workability deteriorates. In addition, since hydrogen may be solid-solubilized in Ni, and blowholes may be caused at the time of melting and casting, if the amount of addition of Ni is large, fractures may be caused by an intermediate process. Since Si reacts with C or reacts with O, if the amount of addition is large, quite a lot of inclusions may be formed and fractures may be caused at the time of bending.

Here, an appropriate amount of addition of Si is 0.1 to 1.4% by mass and preferably 0.2 to 1.0% by mass. An appropriate amount of addition of Ni is 0.4 to 6.0% by mass and preferably 1.0 to 5.0% by mass.

Precipitates of Ni—Si compound particles are generally formed in a stoichiometric composition, and the mass ratio of Ni and Si approximates to the mass composition ratio of $Ni_2Si$ (Atomic Weight of Ni×2:Atomic Weight of Si×1) that is an intermetallic compound, that is, the mass ratio of Ni and Si is Ni/Si=3 to 7, or preferably 3.5 to 5, so that satisfactory electrical conductivity may be obtained. If the ratio of Ni is higher than the mass composition ratio described above, the electrical conductivity is likely to decrease, and if the ratio of Si is higher than the mass composition ratio described above, the hot workability is likely to deteriorate due to coarse Ni—Si grains.

(Amounts of Addition of Other Elements)

(1) Cr and Co

Cr and Co are solid-solubilized in Cu, and coarsening of grains at the time of performing a solution treatment is suppressed. In addition, strength of an alloy is enhanced. At the time of an aging treatment, silicide is formed and precipitates out, so it impossible to contribute to an increase in strength and electrical conductivity. Since the electrical conductivity of the additive elements rarely decreases, the additive elements may be added as much as desired, but if the amounts of addition are large, adverse influence is exerted on the characteristics. Here, one or both of Cr and Co may be added up to 1.0% by mass in total, and preferably 0.005 to 1.0% by mass.

(2) Mg and Mn

Since Mg or Mn reacts with O, a deoxidation effect of molten metal may be obtained. In addition, Mg and Mn are elements that are generally added to increase alloy strength. The most famous effect is to increase a stress relaxation characteristic what is called a creep resistance characteristic. In recent years, current flow becomes high according to the high integration of electronic equipment, and materials may be deteriorated due to heat in a semiconductor package that has low heat dissipation property such as BGA type, so that a failure may be caused. Especially, in case of vehicle installation, decrease due to heat around an engine may be caused, so heat resistance is an important task. Therefore, Mg and Mn are elements that may be added as much as desired. However, if amounts of addition are too large, adverse influence on bending workability may not be disregarded. Here, one or both of Mg and Mn may be added up to 0.5% by mass in total, and preferably 0.005 to 0.4% by mass.

(3) Sn

Sn has a similar effect as Mg. However, since the amount that is solid-solubilized in Cu is large unlike Mg, Sn is added if more heat resistance is required. Meanwhile, if the amount increases, the electrical conductivity significantly decreases. Accordingly, Sn may be added up to 0.5% by mass, and preferably 0.1 to 0.4% by mass. However, if both of Mg and Sn are added, total concentration of both elements is set up to 1.0% by mass and preferably up to 0.8% by mass for suppressing an adverse influence on electrical conductivity.

(4) Zn

Zn has an effect that suppresses solder embrittlement. However, if amount of addition is large, electrical conductivity decreases. Therefore, Zn may be added up to 0.5% by mass and preferably 0.1 to 0.4% by mass.

(5) Fe, Al, and P

These elements may also increase the alloy strength. The elements may be added as necessary. However, if the amounts of addition are large, the characteristics may be deteriorated according to the additive element. Therefore, the elements may be added up to 0.5% by mass, and preferably 0.005 to 0.4% by mass.

If Cr, Co, Mg, Mn, Sn, Fe, Al, and P described above exceed 1.0% by mass in total, manufacturability is likely to be impaired. Therefore, the total amount of these elements is preferably adjusted to 1.0% by mass or less, and more preferably to 0.5% by mass or less.

(Ni—Si Compound Particles)

Figure 2:
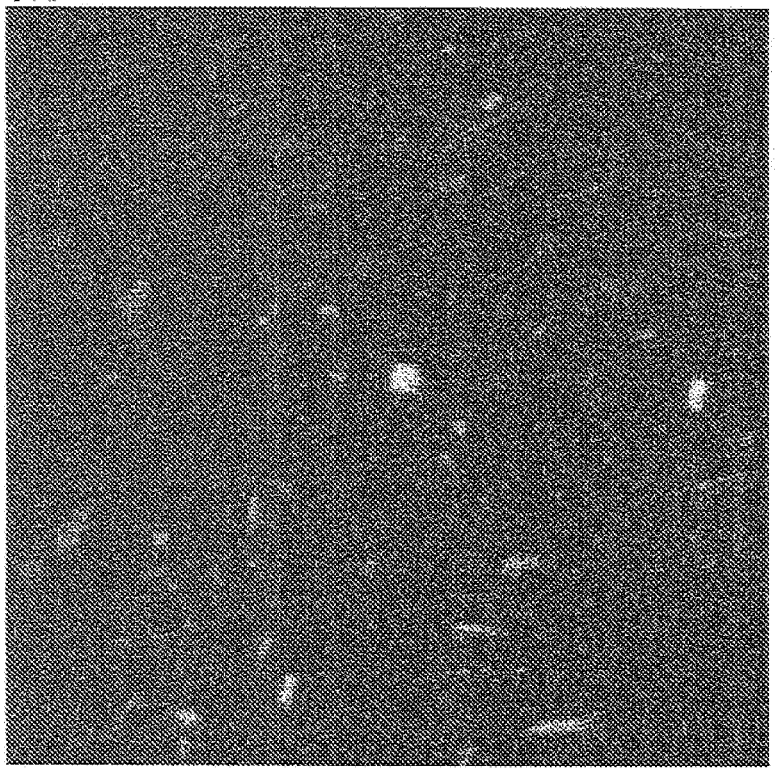
FIG. 2 is a photograph illustrating the large particles in a cross-section in the thickness direction parallel to the rolling direction when observing copper alloy (which is processed by 66%) of the invention by TEM.
Figure 3:
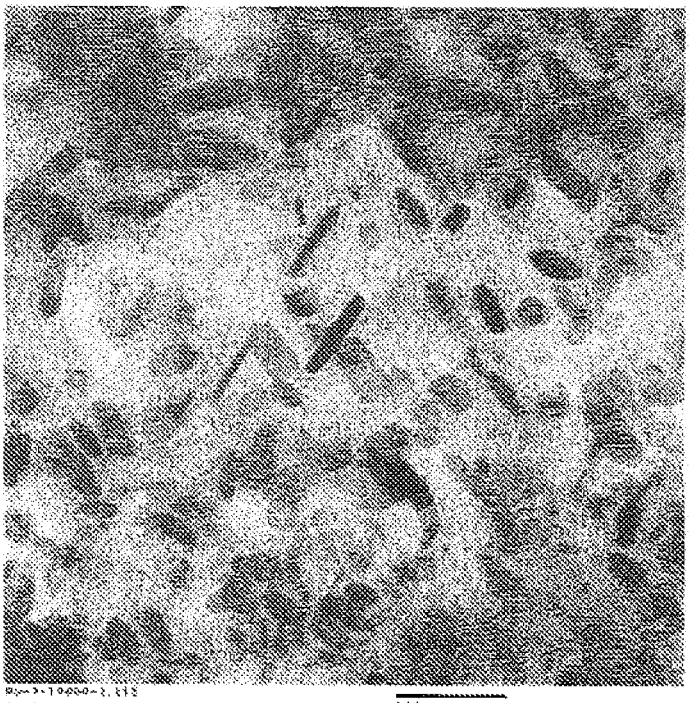
FIG. 3 is a photograph illustrating small particles in cross-section in the thickness direction parallel to the rolling direction when observing copper alloy (which is processed by 0%) of the invention by TEM.
Figure 4:
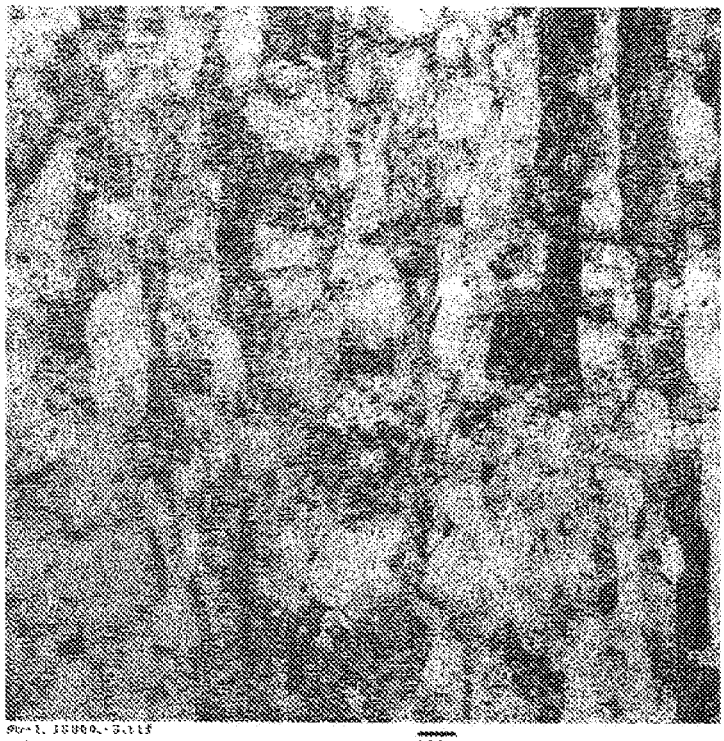
FIG. 4 is a photograph illustrating the small particles in a cross-section in the thickness direction parallel to the rolling direction when observing copper alloy (which is processed by 99%) of the invention by TEM.

According to the invention, Ni—Si compound particles precipitated in a copper matrix are classified into two types of small particles and large particles, and number density, particle sizes, and further interrelation thereof may be controlled. According to the invention, the small particles refer to Ni—Si compound particles with particle sizes of equal to or greater than 0.01 μm and smaller than 0.3 μm, and the large particles refer to Ni—Si compound particles with particle sizes of equal to or greater than 0.3 μm and smaller than 1.5 μm. The small particles are particles that mainly precipitate out in the grains and the large particles are particles that mainly precipitate out to grain boundaries. In addition, Ni—Si compound particles refer to particles in which both of Ni and Si are detected from element analysis. The small particles mainly contribute to heat resistance and strength of the alloy, and the large particles mainly contribute to micronization of grains and maintenance of electrical conductivity. Here, FIG. 1 illustrates large particles in a cross-section in the thickness direction parallel to the rolling direction when observing a copper alloy (which is processed by 0%) of the invention by SEM. FIG. 2 illustrates the large particles in a cross-section in the thickness direction parallel to the rolling direction when observing the copper alloy (which is processed by 66%) of the invention by TEM. FIG. 3 illustrates small particles in a cross-section in the thickness direction parallel to the rolling direction when observing the copper alloy (which is processed by 0%) of the invention by TEM. FIG. 4 illustrates the small particles in a cross-section in the thickness direction parallel to the rolling direction when observing the copper alloy (which is processed by 99%) of the invention by TEM.

Ni—Si compound particles precipitated into grains may be precipitates generally as fine as about tens of nanometers. Among them, since Ni—Si compound particles smaller than 0.3 μm have flux pinning by dislocation, the dislocation density becomes high. Therefore, the strength of the entire alloy is likely to increase. Since Ni—Si compound particles with these particle sizes have small distance between particles and large in number, it is likely to contribute to strength. In addition, since there is an effect of preventing the movement of dislocation at the time of heating, heat resistance increases.

However, if large strain is applied to particles with this size, in particular, Ni—Si compound particles smaller than 0.01 μm are sheared, and the surface area of the sheared particles decreases, so the shear strength decreases. Accordingly, the dislocation density does not increase without leaving dislocation loop. Accordingly, Ni—Si compound particles smaller than 0.01 μm is not likely to contribute to strength. The sheared particles may be solid-solubilized in the copper parent phase again, and may cause the decrease of electrical conductivity. In addition, since the sheared particles do not work as nucleation sites of recrystallization, the recrystallized grains are likely to become coarse. The coarse grains have adverse influence on strength or bendability.

Accordingly, it is advantageous to control the number density of small particles with particle size of equal to or greater than 0.01 μm and smaller than 0.3 μm. Small particles significantly contribute to the increase of strength, but are likely to decrease electrical conductivity if there are too many small particles. Therefore, it is necessary to adjust the number density of small particles to 1 to 2000/$\mu m^2$ in order to achieve the balance between the strength and the electrical conductivity. The number density of the small particles may be measured through a texture observation with a transmission, electron microscope.

Meanwhile, Ni—Si compound particles precipitated to the grain boundaries may be precipitates with sizes of approximately hundreds of nanometers to several micrometers. Among them, Ni—Si compound particles equal to or greater than 0.3 μm and smaller than 1.5 μm may work as strong particles that are not likely to be sheared. The heat resistance and strength of the alloy may increase in the same manner as small particles, but since the particle sizes are large, so the number of particles is small and the distance between particles are large so that the contribution to the heat resistance and the strength is smaller than that of the small particles. However, since the particles are rarely sheared though large stain is applied thereto, the electrical conductivity is not likely to decrease. In addition, the particles that are not sheared may work as nucleation sites at the time of recrystallization. Accordingly, it is likely to form grains finer than the large particles. Fine grains especially contribute to strength and bendability. If particles with the size of greater than 1.5 μm increase, Ni and Si to be used for forming small particles are deficient, so the strength is likely to decrease. If Ag plating or the like is carried out on a material, the plating thickness may partially become large. Therefore, it is likely to form defects of protrusion.

Accordingly, it is advantageous to control the number density of the large particles equal to or greater than 0.3 μm and smaller than 1 μm. The large particles contribute to the increase of electrical conductivity or the miniaturization of grains, but the number density of small particles is likely to decrease if there are too many large particles. Therefore, if the ratio between the numbers of the large particles and small particles is not set to an appropriate scope, balance between both of strength and electrical conductivity may collapse. In specific, if there are many large particles, strength may decrease and if there are many small particles, electrical conductivity may decrease. Therefore, in order to achieve balance between strength and electrical conductivity, the number density of particles in the scope of equal to or greater than 0.3 μm and smaller than 1.5 μm is required to be adjusted to 0.05 to 2/$\mu m^2$. The number density the large particles may be measured through a texture observation with a scanning electron microscope.

In addition, if an aging treatment is carried out as a final process, precipitated particles strain matrix. At this time, if dispersion is carried out in an uneven density, stress is generated due to the uneven strain and remains. If the remaining stress is large, stress is not relieved even by strain relief annealing. In addition, if the large particles converge into a cluster state, unevenness is formed due to the difference from the circumference at the time of plating or etching so that defects in the form of protrusion may be formed. Further, if cold rolling is carried out after an aging treatment, the particles dispersed in the uneven density have different work hardening property from area to area, so uneven formation occurs. In addition to increase the remaining stress, sometimes this may be a cause of fractures. Especially, if the large particles converge into a cluster state, fractures may originate from the portion. Therefore, it is preferable that the small particles and the large particles exist in the even distribution in the copper alloy respectively.

Accordingly, it is preferable that the maximum value of the density ratio per field with regard to the small particles be 10 or smaller, if the unit area of 0.5 μm×0.5 μm is set to one field and 10 fields randomly selected from the surface area of the copper alloy of 100 $mm^2$ are observed, and that the maximum value of the density ratio per field with regard to the large particles be 5 or smaller if the unit area of 20 μm×20 μm is set to one field and 10 fields randomly selected from the surface area of the copper alloy of 100 $mm^2$ are observed.

The effect of exploiting the advantages of both the small particles and the large particles and complementing the defects of both particles may be increased by controlling the difference between average particle sizes of the small particles and the large particles to an appropriate scope. It is preferable that the ratio of the average particle size of the large particles with regard to the average particle size of the small particles be 2 to 50.

It is advantageous that the grains are fine in terms of strength and bendability, but if the grains are too small, the balance between the large particles precipitated to the grain boundaries and the small particles precipitated into the grains collapses. Therefore, if copper alloy of the invention is observed in a cross-section in the thickness direction parallel to the rolling direction, it is preferable that a particle size of grains indicated by circle-equivalent diameter be 1 to 30 μm.

In addition, it is understood that the sizes of the precipitates are like is to be different in the grain boundaries of the grains and in the grains. Therefore, the uneven sizes of the grains mean that precipitated particles are uneven and it is not preferable for the reasons above. Especially, if it is assumed that the rolling process is deformation in the thickness direction, aligning the length of the grains in the thickness direction significantly influences the plastic deformation property in this direction. In recent years, the plate thickness tends to be small, so if the number density of the grains with regard to the plate thickness is uneven, it is expected that fractures may occur from the portion as an origination. For this reason, it is preferable that the particle sizes of the grains be even in length of the thickness direction parallel to the rolling direction. Accordingly, it is preferable that the maximum value of the ratio of the particle sizes of neighboring grains be 3 or smaller in length in the thickness direction parallel to the rolling direction.

(Producing Method)

Next, a description is made to a method of producing a copper alloy according to the invention. The copper alloy according to the invention is based on the conventional method of producing Cu—Ni—Si alloy and may be produced through a partially specific process.

First, by using an atmosphere melting furnace, raw materials such as electrolytic copper, Ni, and Si are melt, so that molten metal with a desired composition is obtained. At this time, in order to prevent particles form coarsening, it is important to maintain molten metal after addition of Ni and Si in the temperature of 1130 to 1300° C. if the Ni concentration is 0.4 to 3.0% by mass, and in the temperature of 1250 to 1350° C. if the Ni concentration is 3.0 to 6.0% by mass, In this manner, since the melting/holding temperature changes depending on the Ni concentration, the generation of the large particles may be appropriately controlled.

Subsequently, the molten metal is cast into an ingot. Next, hot rolling is carried out after heating at 800 to 900° C. if Ni in the ingot is less than 2.0% by mass, at 850 to 950° C. if Ni in the ingot is equal to or greater than 2.0% by mass and less than 3.0% by mass, at 900 to 1000° C. if Ni in the ingot is equal to or greater than 3.0% by mass and less than 4.0% by mass, and at equal to or greater than 950° C. if Ni in the ingot is equal to or greater than 4.0% by mass. If the large particles are not sufficiently dissipated or miniaturized in a heat treatment before the hot rolling, the solution treatment is not likely to be carried out, so that large particles remain. In a Cu—$Ni_2Si$ phase diagram, as the Ni concentration, is high, the temperature of solid solubilization is high. Therefore, the temperature of a heat treatment is set high as the Ni concentration becomes high. If a temperature is lower than the temperature described above, Ni and Si are not sufficiently solid-solubilized. If a temperature is higher than the temperature described above, the solid solubilization is facilitated but breaking may occur due to the interaction between the coarsely recrystallized grains at a high temperature and the product generated at a high temperature. Therefore, it is not preferable. By adjusting the plate thickness at the time of finishing hot rolling to be thinner than 20 mm, cooling is carried out quickly, so that the precipitation of precipitates that does not contribute to the characteristic may be prevented. At this point, the hot rolling may be finished, at the high temperature of 600° C. or greater, but if the solution treatment at a later process is difficult, it is effective to finish the hot rolling at a lower temperature.

Next, cold rolling is carried out. The cooling rate at a solution treatment described below becomes fast by performing the cold rolling, so that the precipitation of solid-solubilized Ni and Si may be suppressed adequately. The plate thickness after the cold rolling is preferably 1 mm or less, more preferably 0.5 mm or less, and most preferably 0.3 mm or less.

Next, a solution treatment is carried out. In the solution treatment, Ni—Si composition is solid-solubilized in the Cu matrix and at the same time the Cu matrix is recrystallized. According to the Cu—$Ni_2Si$ phase diagram, as the temperature is high, the solid solubilization of Ni and Si is facilitated. Therefore, in the conventional art, a solution treatment has been generally performed at a temperature higher than the temperature of the solid solubilization according to the Cu—$Ni_2Si$ phase diagram. This is to prevent coarse particles that remain due to the insufficient solution treatment from becoming defects since these particles generate defects in electrodeposition in plating. After reviewing these particles, it is understood that the cause exists in the cooling procedure in the hot rolling process after casting and reheating treatments. However, since it is difficult to control the cooling in any processes and Ni and Si may be solid-solubilized in a lump by a solution treatment, the process has rarely attracted an attention in the conventional art. Meanwhile, as a performance required to connectors in recent years, since the characteristics of the material is deficient at the design stage, a bending process that requires high load has been demanded. In this regard, as a result of a review for improving the characteristics of conventional alloy, it is understood that the problem would be solved by leaving no coarse precipitates in a solution treatment and controlling grains to have the size of 5 to 30 μm. The conventional producing method was not able to achieve one of the both, so it has been selected to cover the characteristic with other alternatives rather than making defects in plating. That is, instead of coarsening the grains, strengths has been increased by increasing the working degree of subsequent cold rolling. However, if the working degree increases, bendability decreases, so that deformation processing may not be carried out in the recent connectors. Optimization of the density difference between large particles and small particles and bendability owing to low working degree of cold rolling may be improved by controlling the grains.

Therefore, in the invention, the condition of the solution treatment is strictly controlled. Specifically, in order to sufficiently solid-solubilize additive elements, especially Ni, a solution treatment temperature of a certain degree or greater is selected according to the Ni concentration. However, if the temperature is too high, the grains sizes become too large, so that the high temperature is not always preferable. In specific, if Ni concentration is high, the temperature is set to be high. As a rough standard, the temperature is set to be approximately 650 to 700° C. in 1.5% by mass of Ni, 800 to 850° C. in 2.5% by mass of Ni, and 900 to 950° C. in 3.5% by mass of Ni. In a more generalized manner, if it is assumed that x the Ni concentration (% by mass) in the ingot, a solution treatment is carried out at a solution treatment temperature, y (° C.) indicated by y=125x+(475 to 525). Therefore, in setting the precipitation state of the large particles and small particles to a scope defined in the invention, it is important to adjust the time and the temperature of the solution treatment such that the grains sizes after the solution treatment is set in the scope of 5 to 30 μm if viewed from the cross section perpendicular to the rolling direction. In addition, if the plate thickness of material at the time of the solution treatment is large, though the plate is cooled after the solution treatment, a sufficient cooling rate may not be obtained, and it is likely that solid-solubilized additive elements precipitate out during the cooling. Accordingly, it is preferable that the plate thickness at the time of performing the solution treatment be equal to or smaller than 0.3 mm. In addition, in order to suppress the precipitation of the additive elements, the average cooling rate of from the solution treatment temperature to 400° C. is preferably 10° C./second or greater, and more preferably 15° C./second or greater. These cooling rates may be achieved by air cooling if the plate thickness is approximately equal to or thinner than 0.3 mm, but water cooling is more preferable. However, if the cooling rate is too high, the shape of the product becomes bad, so that the cooling rate is preferably less than or equal to 30° C./second, and more preferably less than or equal to 20° C./second.

After the solution treatment, an aging treatment is carried out without performing cold rolling. If the cold rolling is carried out, the dislocation density increases and the precipitation of the precipitates is facilitated, since defects in a parent phase such as grain boundaries, vacancies, and dislocations become a preferential precipitation site. Accordingly, the precipitation is facilitated by performing cold rolling, but the particles precipitated to the grain boundary are large particles as described above, so that the ratio of the precipitates intended in the invention, collapses. Further, recently, it has been known that the grain boundaries formed by the cold rolling are different in characteristics from the grain boundaries after the heat treatment (after the solution treatment). The grain boundaries formed by the cold rolling are mainly configured by dislocation, and it is understood that the energy of the grain boundaries is higher in the grain boundaries by the cold rolling. Accordingly, though it is assumed that the grains after the solution treatment and the grains after the solution treatment and the cold rolling have the same sizes, the particles precipitated in the aging after that are totally different. It is possible to change the characteristics (to change the balance between strength and electrical conductivity) by using these phenomena to intentionally increase large particles, but the overall characteristic (bendability and etching, characteristic) intended by the invention may not be achieved. The decrease of the bending workability may be suppressed depending on the condition of solution treatment (deficient precipitates in the aging due to insufficient solution treatment), but it is difficult to sufficiently draw the function of the materials, since the solution treatment is insufficient. If the cold rolling is carried out between the solution treatment and an aging treatment, strength and electrical conductivity is a little bit high, but the bending workability may decrease and also the precipitates may not be distributed as intended by the invention. Accordingly, in the invention, the cold rolling is not performed after the achievement of the desired grains and the solid solubilization state by she solution treatment.

In addition, the condition of an aging treatment in the invention is important, it is preferable to control the distribution state of large particles and small particles by a single aging treatment for producing the copper alloy according to the invention. Japanese Patent No. 3797736 employs a method in which large particles and small particles precipitate out by performing an aging treatment twice, but, as generally known in the art, once precipitates precipitate out, Ni and Si concentration that are solid-solubilized in the copper decreases, so Ni and Si hardly diffuses and thus the precipitation becomes difficult. Therefore, the number density of small particles may not be obtained as intended in the invention. In addition, since a second aging treatment influences the size of the precipitation particles previously generated in a first aging treatment, it is difficult to control the particle diameter or the density.

In order to adjust large particles and small particles to be a desired scope by a single aging treatment, it is a precondition to appropriately perform a solution treatment as a preceding process, but it is important to adjust the temperature and the time to an appropriate scope. The strength and the electrical conductivity are increased by the aging treatment. The aging treatment may be carried out for 0.5 to 50 hours at the temperature of 300 to 600° C., but be carried out for a short time if a heating temperature is high, and be carried out for a long time if the heating temperature is low. This is because the Ni—Si compound particles tend to be coarse if an aging treatment is carried out for a long time at a high temperature, and the Ni—Si compound particles do not sufficiently precipitate out if an aging treatment is carried out for a short time at a low temperature. As a preferred example, an aging treatment may be carried out for approximately an aging time, z (h) indicated by z=−0.115 t+61 if the heating temperature t (° C.) is equal to or higher than 300° C. and lower than 500° C., and for approximately an aging time, z (h) indicated by z=−0.0275 t+17.25 if the heating temperature t (° C.) is equal to or higher than 500° C. and lower than 600° C. For example, it is preferable that an aging treatment be carried out for approximately 15 hours at 400° C. for approximately 2 to 5 hours at 500° C., and for approximately 0.5 to 1 hour at 600° C. In order to obtain higher strength, the cold rolling may be carried out after the aging. In the case of conducting cold rolling after aging, a stress relief annealing (a low temperature annealing) may be carried out after the cold rolling.

The copper alloy according to the invention may be processed into various wrought copper product, such as a plate, a strip, a pipe, a rod, and a wire, and further the copper alloy according to the invention may be used in an electronic component such as a lead frame, a connector, a pin, a terminal, a relay, a switch, a thin film for a secondary battery, which is required to reconcile high strength and high electrical conductivity (or thermal conductivity).

EXAMPLE

Hereinafter, specific examples of the invention will be described, but these examples are provided to help better understanding of the invention and its advantages, and are not intended to limit the invention by any means.

Copper alloys with various component compositions indicated in Tables 1 to 4 were melted in a high frequency melting furnace, were maintained at each melting holding temperature, and were cast into an ingot having a thickness of 30 mm. Thereafter, this ingot was heated at each reheating treatment temperature, then was hot rolled at 850 to 1050° C. for 0.5 to 5 hours (the material temperature at the time of completion of hot rolling was 500° C.) to obtain a plate thickness of 10 mm, and then surface grinding was applied by a thickness of 8 mm in order to remove scale at the surface. Subsequently, after the plate thickness becomes 0.15 mm or 0.10 mm by the cold rolling, solution treatment was earned out under the conditions indicated in Tables 1 to 4. Subsequently, aging treatment was applied under the various conditions indicated in Tables 1 to 4 in an inert atmosphere. In addition, the plate thickness of 0.10 mm was obtained by further cold rolling the plate thickness of 0.15 mm. In this manner, each of the produced specimens with the plate thickness of 0.10 mm was evaluated. Tables 1, 3, and 4 indicate manufacture examples of Cu—Ni—Si copper alloy, and Table 2 indicates a manufacture example of Cu—Ni—Si copper alloy in which Mg, Cr, Sn, Zn, Mn, Co, Fe, and P were appropriately added. In addition, Comparative Examples 9 to 11 were subjected to cold rolling under the condition indicated in Table 3 between solution treatment and aging treatment, respectively.

Characteristic evaluations were carried out with regard to each of the alloys obtained in this manner, and the results are described in Tables 1 to 4.

Tensile tests in the direction parallel to the rolling direction were carried out with regard to strength, and tension strength and 0.2% yield strength (MPa) were measured.

Electrical conductivity (% IACS) was determined by measuring the volume resistivity by a double bridge method.

As a bendability test, W bending tests in a good way (a direction in which a bending axis is perpendicular to a rolling direction) and a bad way (a direction in which a bending axis is the same direction as a rolling direction) were carried out according to JIS H 3130 to measure an MBR/t value which is a ratio of minimum radius (MBR) with regard to plate thickness (t) in which fractures may not occur.

After the solution treatment, a cross section in the thickness direction parallel to the rolling direction was cut by a fine cutter, then a cold resin embedding was performed, and then mirror polishing (1 micron buff) treatment was carried out. Subsequently, electrolytic polishing was carried out and grains were observed using a scanning electron microscope (SEM) (trade name: HITACHI-S-4700). With regard to grains sizes, an average value of 10 grains in the width in the processing direction was determined.

It is possible to measure the grains sizes of a final product by the method described below. First, the cross section in the thickness direction parallel to the rolling direction was subjected to electrolytic polishing, and the sectional structure was observed by SEM, and the number of grains per unit area was counted. In addition, the size of the entire observation field of vision was added up, the resultant was divided by the counted total of the grains, and then the dimension per one grain was calculated. According to the calculated dimension, a diameter of a true circle (a circle-equivalent diameter) with a dimension the same as the calculated dimension may be calculated, and the diameter may be designated as an average grains sizes.

The particle sizes of large particles and small particles may be observed from any cross sections. In the examples, with regard to the cross section parallel to the rolling, direction of the product, large particles are observed by a scanning electron microscope HITACHI-S-4700), and small particles are observed by a transmission electron microscope (HITACHI-H-9000). In addition, small particles are observed in 10 fields of vision randomly selected from the surface area of the copper alloy of 100 $mm^2$ if the unit area of 0.5 μm×0.5 μm is set to one field of vision. Large particles are observed in 10 fields of vision randomly selected from the surface area of the copper alloy of 100 $mm^2$ if the unit area of 20 μm×20 μm is set to one field of vision. In this manner, by observing 10 fields of vision, the test was performed so that approximately 100 particles may be observed, respectively. Photographing was carried out at a magnification ratio of 500 to 700 thousand times if the sizes of the precipitates were 5 to 100 nm, and at a magnification ratio of 50 to 100 thousand times if the sizes of the precipitates were 100 to 5000 nm. However, it is difficult to observe precipitates with the size smaller than 5 nm. It is possible to observe precipitates with the size greater than 5000 nm with a scanning electron microscope.

With regard to the particles observed in this manner, the dimension was calculated by a long diameter and a short diameter of each particle, the diameter of a true circle (a circle-equivalent diameter) having the same dimension as the calculated dimension was calculated from the calculated dimension, and the calculated diameter was able to be a particle diameter. Particles were classified into large particles and small particles according to the particle sizes, the particle diameters were respectively aggregated with the number of particles, the sum of the particle diameters was divided by the number of particles to obtain an average particle diameter, and the sum of the numbers of the particles was divided by the total dimension of the observation field of vision, so that the number density was obtained. Here, the long diameter refers to the length of the longest line segment among line segments that pass the center of a particle and have intersection points with the border line as both ends, and the short diameter refers to the length of the shortest line segment among line segments that pass the center of a particle and have intersection points with the border line as both ends.

It was confirmed that the observed particles were Ni—Si compound particles by a method of element mapping with a scanning electron microscope equipped with EDS, especially a field emission electron microscope that is precise in element analysis, and that the small particles were Ni—Si compound particles by a method of element mapping with a transmission electron microscope equipped with EELS.

However, in final products, the dislocation was significantly high and it was difficult to observe the precipitates. In this case, for the easier observation, it is preferable to perform a stress relief annealing at the temperature of approximately 200° C. at which precipitation was not carried out. In addition, an electrolytic polishing method is used for preparing a sample for a general transmission electron microscope, but the measurement may be carried out by preparing a thin film by FIB (Focused Ion Beam).

TABLE 1

| | Alloy Composition | | Preparation Condition | | | | | | | Cold Working | Precipitate | |
|---|---|---|---|---|---|---|---|---|---|---|---|---|
| | First Additive Element (wt %) | | Melting/ Holding Temperature | Releasing Treatment Temperature | Solution Treatment Temperature | Size of Grain | Size Ratio of Neighboring Grain | Aging Condition Temperature | Aging Condition Time | After Aging (Performed: ○, Not Performed: X) | Large Particle Diameter | Small Particle Diameter |
| | Ni | Si | (°C.) | (° C.) | (° C.) | (μm) | | (° C.) | (h) | | (nm) | (nm) |
| Example 1 | 1.50 | 0.35 | 1180 | 800 | 750 | 18 | 1.6 | 600 | 0.5 | ○ | 308 | 65 |
| Example 2 | 1.50 | 0.36 | 1190 | 820 | 750 | 23 | 1.4 | 575 | 1 | ○ | 553 | 54 |
| Example 3 | 1.50 | 0.32 | 1200 | 830 | 750 | 15 | 1.7 | 550 | 2 | X | 354 | 52 |

TABLE 1-continued

| | | | | | | | | | | | | |
|---|---|---|---|---|---|---|---|---|---|---|---|---|
| Example 4 | 1.50 | 0.37 | 1200 | 650 | 750 | 23 | 2.3 | 525 | 3 | X | 794 | 96 |
| Example 5 | 1.50 | 0.32 | 1210 | 670 | 750 | 22 | 1.3 | 500 | 3 | X | 663 | 21 |
| Example 6 | 1.50 | 0.32 | 1200 | 800 | 750 | 15 | 1.5 | 450 | 10 | ○ | 1291 | 45 |
| Example 7 | 1.50 | 0.33 | 1200 | 800 | 750 | 14 | 1.6 | 400 | 50 | X | 658 | 50 |
| Example 8 | 2.50 | 0.50 | 1250 | 850 | 800 | 14 | 1.1 | 600 | 0.5 | ○ | 393 | 128 |
| Example 9 | 2.50 | 0.53 | 1270 | 880 | 800 | 16 | 2.5 | 575 | 1 | X | 660 | 67 |
| Example 10 | 2.50 | 0.60 | 1260 | 800 | 800 | 20 | 1.4 | 550 | 2 | X | 531 | 52 |
| Example 11 | 2.50 | 0.52 | 1250 | 950 | 850 | 17 | 1.6 | 525 | 4 | ○ | 595 | 52 |
| Example 12 | 2.50 | 0.56 | 1280 | 900 | 850 | 14 | 1.8 | 500 | 3 | X | 850 | 25 |
| Example 13 | 2.50 | 0.56 | 1250 | 920 | 850 | 15 | 1.1 | 475 | 7 | ○ | 667 | 42 |
| Example 14 | 2.50 | 0.55 | 1250 | 810 | 850 | 17 | 1.9 | 400 | 20 | X | 507 | 23 |
| Example 15 | 3.50 | 0.85 | 1250 | 900 | 900 | 8 | 1.5 | 575 | 1 | ○ | 776 | 58 |
| Example 16 | 3.50 | 0.86 | 1250 | 810 | 900 | 6 | 1.3 | 550 | 2 | X | 418 | 118 |
| Example 17 | 3.50 | 0.79 | 1250 | 920 | 900 | 11 | 1.5 | 525 | 3 | X | 609 | 194 |
| Example 18 | 3.50 | 0.72 | 1290 | 930 | 950 | 10 | 1.5 | 500 | 3 | ○ | 658 | 26 |
| Example 19 | 3.50 | 0.74 | 1290 | 950 | 925 | 3 | 1.4 | 475 | 5 | ○ | 1213 | 258 |
| Example 20 | 4.50 | 1.24 | 1290 | 980 | 925 | 17 | 1.7 | 450 | 10 | ○ | 676 | 299 |
| Example 21 | 5.50 | 1.32 | 1300 | 980 | 950 | 18 | 2.1 | 425 | 25 | ○ | 1104 | 221 |
| Example 22 | 2.50 | 0.56 | 1250 | 880 | 850 | 24 | 1.1 | 600 | 14 | ○ | 775 | 44 |
| Example 23 | 2.50 | 0.54 | 1250 | 910 | 850 | 25 | 1.8 | 580 | 30 | ○ | 798 | 52 |

| | Precipitate | | | Maximum Density | Maximum Density | Evaluation | | | | |
|---|---|---|---|---|---|---|---|---|---|---|
| | Size Ratio Between Large Particle and Small Particle | Large Particle Number Density (piece/μm²) | Small Particle Number Density (piece/μm²) | Ratio between Fields of Vision of Large Particle | Ratio between Fields of Vision of Small Particle | Tension Strength (MPa) | 0.2% Yield Strength (MPa) | Electrical conductivity (% IACS) | Bending Workability GW (MBR/t) | Bending Workability BW (MBR/t) |
| Example 1 | 4.7 | 0.27 | 5 | 3.3 | 1.2 | 612 | 606 | 56 | 0.0 | 0.0 |
| Example 2 | 12.1 | 0.38 | 3 | 1.7 | 1.0 | 628 | 624 | 52 | 0.0 | 0.0 |
| Example 3 | 68 | 0.76 | 469 | 1.2 | 1.7 | 570 | 555 | 49 | 0.0 | 0.0 |
| Example 4 | 83 | 0.19 | 1033 | 1.3 | 1.4 | 616 | 594 | 47 | 0.0 | 0.0 |
| Example 5 | 31.6 | 0.56 | 1427 | 2.5 | 1.0 | 631 | 616 | 44 | 0.0 | 0.0 |
| Example 6 | 28.7 | 0.84 | 19 | 1.3 | 1.0 | 671 | 659 | 46 | 0.2 | 0.0 |
| Example 7 | 13.2 | 0.65 | 703 | 1.2 | 1.9 | 634 | 620 | 47 | 0.0 | 0.0 |
| Example 8 | 3.1 | 0.06 | 17 | 4.4 | 1.1 | 775 | 759 | 42 | 1.0 | 0.7 |
| Example 9 | 9.9 | 0.27 | 1088 | 3.2 | 1.1 | 742 | 731 | 45 | 0.0 | 0.0 |
| Example 10 | 10.2 | 1.41 | 1024 | 1.0 | 1.1 | 744 | 731 | 44 | 0.2 | 0.2 |
| Example 11 | 11.4 | 0.23 | 17 | 3.7 | 2.1 | 792 | 772 | 43 | 0.7 | 0.9 |
| Example 12 | 34.0 | 1.33 | 507 | 4.6 | 1.2 | 778 | 753 | 41 | 0.6 | 0.6 |
| Example 13 | 15.9 | 1.62 | 58 | 3.3 | 2.0 | 808 | 796 | 39 | 1.0 | 0.8 |
| Example 14 | 22.0 | 0.80 | 908 | 2.4 | 1.0 | 753 | 726 | 42 | 0.5 | 0.5 |
| Example 15 | 13.4 | 1.15 | 29 | 4.3 | 1.6 | 924 | 908 | 32 | 1.4 | 1.2 |
| Example 16 | 35 | 1.07 | 739 | 3.8 | 1.2 | 867 | 836 | 34 | 1.0 | 1.0 |
| Example 17 | 31 | 1.72 | 1009 | 3.4 | 1.1 | 865 | 837 | 34 | 1.0 | 1.0 |
| Example 18 | 25.3 | 1.80 | 22 | 4.1 | 1.9 | 907 | 904 | 31 | 1.4 | 1.2 |
| Example 19 | 4.7 | 1.05 | 14 | 4.5 | 4.1 | 813 | 890 | 31 | 1.4 | 1.4 |
| Example 20 | 2.3 | 0.81 | 38 | 2.0 | 1.6 | 929 | 918 | 28 | 1.4 | 1.4 |
| Example 21 | 5.0 | 0.65 | 92 | 4.0 | 1.7 | 932 | 912 | 27 | 1.4 | 1.4 |
| Example 22 | 17.6 | 0.38 | 50 | 3.5 | 3.2 | 756 | 721 | 45 | 1.0 | 0.6 |
| Example 23 | 15.3 | 0.39 | 63 | 3.5 | 1.5 | 778 | 744 | 46 | 1.0 | 0.6 |

TABLE 2

| | Alloy Composition | | | Preparation Condition | | | | | | | Cold Working | Precipitate Large |
|---|---|---|---|---|---|---|---|---|---|---|---|---|
| | First Additive Element (wt %) | | Second Additive Element | Melting/Holding Temperature | Releasing Treatment Temperature | Solution Treatment Temperature | Length of Crystal Grain | Ratio of length of Neighboring Grain | Aging Condition Temperature | Aging Condition Time | After Aging (Performed: ○, Not Performed: X) | Particle Diameter |
| | Ni | Si | (wt %) | (°C.) | (° C.) | (° C.) | (μm) | Grain | (° C.) | (h) | formed: X) | (nm) |
| Example 24 | 2.50 | 0.50 | Mg0.1 | 1250 | 900 | 800 | 18 | 1.6 | 525 | 3 | ○ | 526 |
| Example 25 | 2.50 | 0.53 | Cr0.1 | 1250 | 900 | 800 | 23 | 1.4 | 525 | 3 | ○ | 1232 |
| Example 26 | 2.50 | 0.60 | Mg0.1—Cr0.1 | 1250 | 900 | 800 | 15 | 1.7 | 525 | 3 | X | 487 |
| Example 27 | 2.50 | 0.52 | Sn0.3—Zn0.3 | 1250 | 900 | 800 | 23 | 2.3 | 525 | 3 | X | 663 |
| Example 28 | 2.50 | 0.57 | Mn0.2 | 1250 | 900 | 800 | 22 | 1.3 | 525 | 3 | ○ | 792 |

TABLE 2-continued

| | | | | | | | | | | | | |
|---|---|---|---|---|---|---|---|---|---|---|---|---|
| Example 29 | 2.50 | 0.55 | Cr0.1—Co0.1 | 1250 | 900 | 800 | 15 | 1.5 | 525 | 3 | ○ | 1132 |
| Example 30 | 2.50 | 0.50 | Fe0.1—P0.03 | 1250 | 900 | 800 | 14 | 1.6 | 525 | 3 | ○ | 713 |

| | Precipitate | | | | Maximum Density Ratio | Maximum Density Ratio | Evaluation | | | | |
|---|---|---|---|---|---|---|---|---|---|---|---|
| | Small Particle Diameter (nm) | Size Ratio Between Large Particle and Small Particle | Large Particle Number Density (piece/μm²) | Small Particle Number Density (piece/μm²) | between Fields of Vision of Large Particle | between Fields of Vision of Small Particle | Tension Strength (MPa) | 0.2% Yield Strength (MPa) | Electrical conductivity (% IACS) | Bending Workability GW (MBR/t) | Bending Workability BW (MBR/t) |
| Example 24 | 27 | 19.5 | 0.31 | 8 | 1.7 | 1.1 | 728 | 723 | 45 | 1.0 | 0.8 |
| Example 25 | 53 | 23.2 | 0.23 | 21 | 2.1 | 1.5 | 740 | 740 | 44 | 1.0 | 0.6 |
| Example 26 | 94 | 5.2 | 0.29 | 639 | 1.9 | 1.2 | 636 | 638 | 45 | 0.0 | 0.0 |
| Example 27 | 63 | 10.5 | 0.57 | 1015 | 1.6 | 1.1 | 725 | 728 | 40 | 0.1 | 0.0 |
| Example 28 | 47 | 16.8 | 1.62 | 25 | 1.6 | 1.5 | 736 | 733 | 38 | 0.8 | 0.6 |
| Example 29 | 70 | 16.2 | 1.77 | 18 | 2.6 | 1.3 | 798 | 797 | 37 | 0.6 | 0.6 |
| Example 30 | 75 | 8.5 | 0.83 | 31 | 2.4 | 1.1 | 768 | 768 | 38 | 0.8 | 0.9 |

TABLE 3

| | Alloy Composition | | Preparation Condition | | | | | | | Cold Working | Precipitate | |
|---|---|---|---|---|---|---|---|---|---|---|---|---|
| | First Additive Element (wt %) | | Melting/Holding Temperature | Releasing Treatment Temperature | Solution Treatment Temperature | Size of Grain | Size Ratio of Neighboring Grain | Aging Condition Temperature | Aging Condition Time | After Aging (Performed: ○, Not Performed: X) | Large Particle Diameter | Small Particle Diameter |
| | Ni | Si | (°C.) | (° C.) | (° C.) | (μm) | | (° C.) | (h) | | (nm) | (nm) |
| Comparative Example 1 | 2.50 | 2.10 | 1250 | 950 | Not Examined Because of Breaking during Hot Rolling | | | | | | | |
| Comparative Example 2 | 7.00 | 0.36 | 1310 | 950 | Not Examined Because of Breaking during Hot Rolling | | | | | | | |
| Comparative Example 3 | 2.50 | 0.54 | 1260 | 950 | 550 | 3 | 3.5 | 525 | 5 | X | 3257 | 38 |
| Comparative Example 4 | 2.50 | 0.54 | 1260 | 950 | 1050 | 82 | 4.3 | 525 | 3 | X | 678 | 52 |
| Comparative Example 5 | 2.50 | 0.54 | 1260 | 950 | 850 | 22 | 1.3 | 550° C., 450° C. × 5 h (twice) | | X | 942 | 5 |
| Comparative Example 6 | 2.50 | 0.54 | 1260 | 950 | 850 | 16 | 1.5 | 700 | 10 | X | 458 | — |
| Comparative Example 7 | 2.50 | 0.54 | 1260 | 950 | 850 | 18 | 1.7 | 400 | 168 | ○ | — | 284 |
| Comparative Example 8 | 2.50 | 0.54 | 1260 | 950 | 800 | 14 | 1.1 | 600 | 0.0027 | ○ | — | — |
| Comparative Example 9 | 2.50 | 0.54 | 1260 | 950 | 800 | 16 | 2.5 | Rolling Between Solutionizing and Aging 60% 525 | 5 | X | 347 | 23 |
| Comparative Example 10 | 2.50 | 0.54 | 1260 | 950 | 800 | 16 | 2.5 | Rolling Between Solutionizing and Aging 30% 525 | 5 | X | 481 | 41 |
| Comparative Example 11 | 2.50 | 0.54 | 1260 | 950 | 800 | 16 | 2.5 | Rolling Between Solutionizing and Aging 90% 525 | 5 | X | 568 | 16 |
| Comparative Example 12 | 2.50 | 0.54 | 1260 | 950 | 800 | 20 | 1.4 | 550 | 2 | ○ Cold Rolling After Aging 70% | 334 | — |
| Comparative Example 13 | 2.50 | 0.50 | 1150 | 900 | 800 | 21 | 1.1 | 475 | 5 | X | 5683 | 59 |
| Comparative Example 14 | 2.50 | 0.50 | 1350 | 900 | 800 | 16 | 1.1 | 600 | 5 | X | 4324 | 49 |
| Comparative Example 15 | 2.50 | 0.50 | 1260 | 1000 | 950 | 34 | 1.1 | 600 | 5 | X | 670 | 78 |
| Comparative Example 16 | 2.50 | 0.50 | 1260 | 700 | 800 | 8 | 1.1 | 600 | 5 | X | 2951 | 55 |

TABLE 3-continued

| | | | | | | | | | | | | |
|---|---|---|---|---|---|---|---|---|---|---|---|---|
| Comparative Example 17 | 2.50 | 0.50 | 1260 | 900 | 700 | 6 | 1.1 | 600 | 5 | X | 3214 | 51 |
| Comparative Example 18 | 2.50 | 0.50 | 1260 | 900 | 950 | 48 | 3.9 | 600 | 5 | X | 812 | 55 |

| | Precipitate | | | Maximum Density | Maximum Density | Evaluation | | | | |
|---|---|---|---|---|---|---|---|---|---|---|
| | Size Ratio Between Large Particle and Small Particle | Large Particle Number Density (piece/μm²) | Small Particle Number Density (piece/μm²) | Ratio between Fields of Vision of Large Particle | Ratio between Fields of Vision of Small Particle | Tension Strength (MPa) | 0.2% Yield Strength (MPa) | Electrical conductivity (% IACS) | Bending Workability GW (MBR/t) | Bending Workability BW (MBR/t) |
| Comparative Example 1 | Not Examined Because of Breaking during Hot Rolling | | | | | | | | | |
| Comparative Example 2 | Not Examined Because of Breaking during Hot Rolling | | | | | | | | | |
| Comparative Example 3 | 65.7 | 0.01 | 4 | 15.0 | 2.3 | 567 | 843 | 50 | 1.0 | 1.0 |
| Comparative Example 4 | 13.0 | 0.001 | 1012 | 1.1 | 1.2 | 584 | 533 | 48 | 1.5 | 1.5 |
| Comparative Example 5 | 168.4 | 0.60 | 0.4 | 1.8 | 8.2 | 668 | 631 | 45 | 1.0 | 0.0 |
| Comparative Example 6 | — | 0.80 | — | 1.6 | — | 642 | 611 | 53 | 1.2 | 1.0 |
| Comparative Example 7 | — | — | 1552 | — | 1.2 | 712 | 554 | 48 | 1.1 | 1.0 |
| Comparative Example 8 | — | — | — | — | — | 678 | 544 | 35 | 0.0 | 0.0 |
| Comparative Example 9 | 13.0 | 2.50 | 304 | 1.4 | 2.3 | 684 | 635 | 51 | 1.8 | 1.8 |
| Comparative Example 10 | 11.7 | 2.10 | 321 | 1.8 | 2.1 | 657 | 611 | 49 | 1.6 | 1.5 |
| Comparative Example 11 | 35.5 | 2.70 | 287 | 1.2 | 2.5 | 731 | 681 | 52 | 2.0 | 2.5 |
| Comparative Example 12 | — | 1.28 | — | 2.1 | — | 824 | 781 | 37 | 1.2 | 5.4 |
| Comparative Example 13 | 96.3 | 3.8 | 354 | 6.2 | 1.3 | 651 | 631 | 30 | 1.5 | 1.3 |
| Comparative Example 14 | 88.2 | 3.9 | 389 | 6.8 | 1.1 | 624 | 591 | 40 | 1.6 | 1.5 |
| Comparative Example 15 | 8.6 | 0.01 | 618 | 1.2 | 1.4 | 638 | 601 | 39 | 1.2 | 1.1 |
| Comparative Example 16 | 53.7 | 4.8 | 289 | 11 | 2.5 | 668 | 622 | 37 | 1.3 | 1.2 |
| Comparative Example 17 | 63.0 | 2.3 | 411 | 9 | 3.8 | 670 | 635 | 42 | 1.5 | 1.3 |
| Comparative Example 18 | 14.8 | 0.4 | 876 | 1.4 | 1.9 | 634 | 600 | 40 | 1.6 | 1.4 |

"— represents that particles in this range were not observed"

TABLE 4

| | Alloy | | Preparation Condition | | | | | | | | Cold | Precipitate | |
|---|---|---|---|---|---|---|---|---|---|---|---|---|---|
| | Composition First Additive Element (wt%) | | Melting/Holding Temperature | Releasing Treatment Temperature | Solution Treatment Temperature | Cooling Rate | Size of Crystal Grain | Ratio in Thickness Direction of Neighboring Grain | Aging Condition Temperature | Aging Condition Time | Working After Aging (Performed: ○, Not Performed: X) | Large Particle Diameter | Small Particle Diameter |
| | Ni | Si | (°C.) | (° C.) | (° C.) | (° C.) | (μm) | | (° C.) | (h) | | (nm) | (nm) |
| Example 31 | 2.50 | 0.52 | 1250 | 900 | 850 | 18 | 22 | 1.5 | 525 | 4 | ○ | 784 | 87 |
| Example 32 | 2.50 | 0.52 | 1250 | 900 | 850 | 18 | 22 | 1.5 | 525 | 4 | X | 656 | 87 |
| Comparative Example 19 | 2.50 | 0.52 | 1250 | 900 | Not provided | — | 38 | 5.2 | 525 | 4 | X | 2145 | 64 |
| Comparative Example 20 | 2.50 | 0.52 | 1250 | 900 | 850 | 5 | 45 | 4.3 | 525 | 4 | X | 618 | 80 |
| Example 33 | 3.50 | 0.73 | 1250 | 950 | 950 | 23 | 15 | 1.1 | 525 | 4 | X | 551 | 83 |

TABLE 4-continued

| | | | | | | | | | | | | | |
|---|---|---|---|---|---|---|---|---|---|---|---|---|---|
| Comparative Example 21 | 3.50 | 0.73 | 1250 | 950 | 950 | 8 | 24 | 3.8 | 525 | 4 | X | 356 | 76 |

| | Precipitate | | | | | | | Evaluation | | | | |
|---|---|---|---|---|---|---|---|---|---|---|---|---|
| | Small Particle Diameter (nm) | Content of Ni—Si (mass %) | Size Ratio Between Large Particle and Small Particle | Large Particle Number Density (piece/μm²) | Small Particle Number Density (piece/μm²) | Maximum Density Ratio between Fields of Vision of Large Particle | Maximum Density Ratio between Fields of Vision of Small Particle | Tension Strength (MPa) | 0.2% Yield Strength (MPa) | Electrical conductivity (% IACS) | Bending Workability GW (MBR/t) | Bending Workability BW (MBR/t) |
| Example 31 | 23 | 89 | 34.1 | 13 | 0.4 | 3.1 | 1.2 | 790 | 765 | 45 | 0.8 | 1.0 |
| Example 32 | 35 | 87 | 7.8 | 452 | 0.1 | 2.1 | 1.1 | 811 | 793 | 42 | 0.9 | 1.1 |
| Comparative Example 19 | 51 | 73 | 42.1 | 512 | 6.1 | 21.0 | 11.0 | 745 | 701 | 41 | 1.5 | 1.2 |
| Comparative Example 20 | 58 | 91 | 10.7 | 668 | 5.2 | 13.0 | 2.5 | 765 | 725 | 47 | 1.6 | 1.3 |
| Example 33 | 12 | 85 | 45.5 | 312 | 0.1 | 4.1 | 2.0 | 1023 | 987 | 35 | 0.8 | 1.0 |
| Comparative Example 21 | 38 | 83 | 8.4 | 806 | 5.4 | 16.0 | 2.7 | 890 | 835 | 38 | 1.3 | 1.2 |

It is understood that strength, electrical conductivity and bending workability are well-balanced in the copper alloy corresponding to Examples of the invention indicated in Tables 1 and 2.

In Comparative Example 1, since Si was not in the scope of the composition, the ratio between Ni and Si was not appropriate, so breaking occurred during hot rolling due to coarse grains.

In Comparative Example 2, since Ni was not in the scope of the composition, Ni was in an excess state. Therefore, hot workability decreased, and breaking occurred during hot rolling.

In Comparative Example 3, since a solution treatment temperature was low, coarse particles remained. Therefore, electrical conductivity became high, but strength became low since the number density of small particles decreased. In addition, fracture occurred from a coarse particle as an origination at the time of bending.

In Comparative Example 4, since the solution treatment temperature is high, grains sizes became large so that large particles decreased while small particles increased. Therefore, strength increased but electrical conductivity decreased. Since grains were large at the time of the solution treatment, bendability decreased by the breaking of grain boundaries at the time of bending.

Comparative Example 5 corresponds to copper alloy described in Japanese Patent No. 3797736. Since aging was performed twice, the sizes of the small particles precipitated at a second aging were small, and the number density significantly decreased. The ratio between large particles and small particles was appropriate, but the number density of small particles became low, so that strength decreased.

In Comparative Example 6, since an aging temperature was high, coarse precipitates increased. Therefore, the density of small particles decreased, so that strength decreased. In addition, it was supposed that electrical conductivity became high, but since the aging temperature was high, so that the electrical conductivity decreased by re-solid solubilization. Fracture occurred from a coarse particle as an origination at the time of bending.

In Comparative Example 7, since aging time was too long, the size of small particles became too large, so that the number density of the small particles became small. Therefore, strength decreased.

In Comparative Example 8, since aging time was too short, there were no precipitate particles and the strength decreased.

In Comparative Examples 9 to 11, cold rolling was performed between a solution treatment and aging, and the degrees of working were 60, 30, and 90%, respectively. Therefore, the precipitates of large particles were facilitated, and the numbers of large particles increased. Accordingly, the numbers of small particles decreased. Though electrical conductivity was high, bending workability was bad. In addition, defects such as bad plating occurred.

In Comparative Example 12, the degree of working of cold rolling after aging was high. In addition, strength was high, but electrical conductivity was low, and the largest characteristic was bad bending workability in a bad way.

In Comparative Example 13, since a melting/holding temperature was too low, the size of large particles became large, and the ratio of an average particle size of large particles to small particles became large, so that strength decreased.

In Comparative Example 14, since a melting/holding temperature was too high, the size of large particles became large, and the ratio of an average particle size of large particles to small particles became large, so that strength decreased.

In Comparative Example 15, since a temperature of the reheating treatment was too high, grains became too large. Accordingly, the balance between large particles and small particles collapsed. Since the grains became coarse, the number of large particles decreased. Since the grains were coarse, strength was low and also electrical conductivity significantly decreased.

In Comparative Example 16, a reheating treatment temperature was too low, the size of large particles became large, and a ratio of an average particle size of large particles to small particles became large, so that strength decreased.

In Comparative Example 17, since a solution treatment temperature was low, the size of large particles became large, and a ratio of an average particle size of large particles to small particles became large, so that strength decreased.

In Comparative Example 18, a temperature of a solution treatment was high, and grains became coarse. Ni and Si were sufficiently solid-solubilized by solution treatment, but balance of precipitates of large particles and small particles collapsed due to coarse grains.

Comparative Example 19 corresponds to copper alloy described in International Publication No. 2008/032738. Since a melting/holding temperature and a temperature of reheating treatment remained constant without appropriately changing the temperatures according to Ni concentration, and further a solution treatment after hot rolling was not performed, sizes of large particles became large and bending workability was bad.

In Comparative Example 20, a cooling rate after a solution treatment was slow and precipitation was carried out during cooling, so that grains became coarse. Therefore, particles that had previously precipitated out became coarse particles during aging treatment. Accordingly, bending fractures occurred due to large particles.

In Comparative Example 21, a cooling rate after a solution treatment was slow, and precipitation way carried out during cooling. Especially, since Ni concentration was high, and flux pinning of precipitates occurred at the same time, grains became uneven.

What is claimed is:

1. A copper alloy for electronic materials comprising 0.4 to 6.0% by mass of Ni and 0.1 to 1.4% by mass of Si, with the balance being Cu and unavoidable impurities, the copper alloy comprising:

small particles of Ni—Si compound having a particle size of equal to or greater than 0.01 μm and smaller than 0.3 μm; and large particles of Ni—Si compound having a particle size of equal to or greater than 0.3 μm and smaller than 1.5 μm;

wherein the number density of the small particles is 1 to 2000 pieces/$\mu m^2$ and the number density of the large particles is 0.05 to 2 pieces/$\mu m^2$.

2. The copper alloy for electronic materials according to claim 1, wherein a maximum value of a density ratio between fields of vision with regard to the small particles is 10 or less if a unit area of 0.5 μm×0.5 μm is set to one field of vision and 10 fields of vision selected from a surface area of the copper alloy of 100 $mm^2$ are observed, and a maximum value of a density ratio between fields of vision with regard to the large particles is 5 or less if a unit area of 20 μm×20 μm is set to one field of vision and 10 fields of vision selected from a surface area of the copper alloy of 100 $mm^2$ are observed.

3. The copper alloy for electronic materials according to claim 1, wherein a ratio of the average particle size of the large particles with regard to the average particle size of the small particles is 2 to 50.

4. The copper alloy for electronic materials according to claim 1, wherein an average grain size indicated by a circle-equivalent diameter is 1 to 30 μm if observed from a cross section in a thickness direction parallel to a rolling direction.

5. The copper alloy for electronic materials according to claim 1, wherein a maximum value of a ratio of particle sizes of neighboring grains is 3 or less in length in the thickness direction parallel to the rolling direction.

6. The copper alloy for electronic materials according to claim 1, further comprising at least one selected from the group consisting of Cr, Co, Mg, Mn, Fe, Sn, Zn, Al, and P in an amount of 1.0% by mass in total.

7. A wrought copper product made from the copper alloy according to any of claims 1 to 6.

8. An electronic component prepared with the copper alloy according to any of claims 1 to 6.

9. A method of producing the copper alloy according to any one of claims 1 to 6, the method comprising, in order:

melting and casting ingot having a desired composition after maintaining molten metal obtained by melting materials containing Ni and Si at 1130 to 1300° C. if Ni concentration is 0.4 to 3.0% by mass and maintaining molten metal obtained by melting materials containing Ni and Si at 1250 to 1350° C. if Ni concentration is 3.0 to 6.0% by mass;

performing hot rolling after heating at 800 to 900° C. if Ni in the ingot is less than 2.0% by mass, at 850 to 950° C. if Ni in the ingot is equal to or greater than 2.0% by mass and less than 3.0% by mass, at 900 to 1000° C. if Ni in the ingot is equal to or greater than 3.0% by mass and less than 4.0% by mass, and at equal to or higher than 950° C. if Ni in the ingot is equal to or greater than 4.0% by mass;

performing cold rolling;

performing a solution treatment at a solution treatment temperature, y (° C.) indicated by $y=125x+(475 \text{ to } 525)$ if x is Ni concentration (% by mass) in the ingot; and performing an aging treatment.

* * * * *